United States Patent [19]

Sampson, Jr.

[11] Patent Number: 4,679,509

[45] Date of Patent: Jul. 14, 1987

[54] WHEEL CHAIR TABLE SYSTEM

[76] Inventor: Samuel O. Sampson, Jr., 4732 Southshore Dr., Metairie, La. 70002

[21] Appl. No.: 745,923

[22] Filed: Jun. 18, 1985

[51] Int. Cl.[4] ..... A47B 39/00

[52] U.S. Cl. ..... 108/27; 297/DIG. 4; 297/174; 108/43

[58] Field of Search ..... 108/27, 43, 161; 312/250; 297/DIG. 4, 174

[56] References Cited

U.S. PATENT DOCUMENTS

| | | | |
|---|---|---|---|
| D. 141,359 | 5/1945 | Carlson | D33/7 |
| 6,475 | 6/1848 | Snyder | 108/43 |
| 157,355 | 12/1874 | Snyder . | |
| 1,293,952 | 2/1919 | Shirley . | |
| 1,719,270 | 7/1929 | Kline . | |
| 2,663,603 | 12/1953 | Newman | 311/23 |
| 2,844,429 | 7/1958 | Frey | 311/25 |
| 3,083,053 | 3/1963 | Dorsey | 108/27 X |
| 3,123,935 | 3/1964 | Williams | 45/85 |
| 3,165,367 | 1/1965 | Rose | 312/250 X |
| 3,771,848 | 11/1973 | Claywell | 312/250 |
| 3,841,699 | 10/1974 | Thomas | 108/43 X |
| 4,229,039 | 10/1980 | Day | 297/DIG. 4 |
| 4,404,915 | 9/1983 | Simpson | 108/43 |
| 4,545,144 | 10/1985 | Schuster | 108/27 X |

FOREIGN PATENT DOCUMENTS

| | | | |
|---|---|---|---|
| 880773 | 10/1961 | United Kingdom | 257/DIG. 4 |

*Primary Examiner*—Peter A. Aschenbrenner
*Attorney, Agent, or Firm*—C. Emmett Pugh

[57] ABSTRACT

A table designed for ease of use by the occupant of a wheel chair having a shaped, cut-back, front edge to allow the torso of the user to extend partially into the working surface, enabling the user to have ease of access to the entire working surface. A peripheral lip or ridge about the back and side edges of the table prevents articles from falling off and out of reach of the user, and the height and table top size are dimensional for use by a wheelchair occupant. The table has casters mounted on its rear leg portions but not on its front leg portions. The table is easily moved by the user who simply tilts the table to lift its front leg portions off of the ground, tilting the table onto the casters mounted on its rear legs, and then rolls the table with him. When the table is tilted for movement the peripheral ridge acts to keep articles on the table. When the table is at a desired location, its front legs are lowered back down into hold contact with the floor. The table is of simple construction, preassembled and then disassembled, with all the parts provided in kit form for assembly and finishing by a handicapped person.

1 Claim, 4 Drawing Figures

WHEEL CHAIR TABLE SYSTEM

BACKGROUND of INVENTION

1. Field of Invention

The present invention relates to handicap assistance devices. More particularly, the present invention relates to special tables for use by handicapped persons confined to wheelchairs.

2. General Background of the Invention

It is difficult for many handicapped persons confined to wheelchairs to use the desks or work tables designed for healthy people sitting in regular chairs. Various table tops or tables have been designed in the past for use by handicapped people, but they have not been satisfactory for use by wheelchair occupants. Indeed, they have been very limited in use, and often clumsy, requiring assistance from another in for example first applying the table top to the chair or removing it for storage while not in use.

It has been known in the table art generally to utilize a cutaway edge to accomodate the body of the user of a table as is shown in for example the patents to Snyder (U.S. Pat. No. 157,355 issued Dec. 1, 1874), Shirley (U.S. Pat. No. 1,293,952 issued Feb. 11, 1919), Newman (U.S. Pat. No. 2,663,603 issued Dec. 22, 1953), Williams (U.S. Pat. No. 3,123,935 issued Mar. 10, 1964) and Carlson (U.S. Pat. No. Des. 141,359 issued May 29, 1945). The concept of a lip or peripheral edge or ridge has also been known in the table art generally as shown in the patents to Newman (U.S. Pat. No. 2,663,603 issued Dec. 22, 1953), Kline (U.S. Pat. No. 1,719,270 issued July 2, 1929) and Frey (U.S. Pat. No. 2,844,429 issued July 22, 1958).

However, the need for a table which will allow ease of use by an individual confined to a wheelchair can not be served adequately by these aspects alone. The wheel chair occupant for example must be able to move and position his work table where it best suits his needs at the time.

Therefore, the design of the table must be one which will enable the wheel chair occupant to easily reposition the table, it must prevent objects from falling from the working surface, and it must permit the user to reach all areas of the work surface from his wheelchair.

Additionally, it is often desirable to provide therapuetic work for a wheelchair occupant, and the table design of the present invention can be provided in easily assembled kit form using only a screwdriver, which can be assembled by a wheelchair occupant and finished (stained, painted, etc.) by the occupant.

3. General Discussion of the Invention

Thus, the present invention is directed to tables designed for use by occupants of wheelchairs. Wheelchair occupants need to be able to reach all areas of their working surface from a sitting position, and therefore the present invention is designed with a centrally located indentation or cut back portion in the front edge of the working surface where the user would sit to allow the body of the user to extend at least partially into the working surface in order to provide greater access to the entire working surface, with all of the work surface being within an arm's reach.

The wheelchair occupant also must be able to easily move the table about and easily reposition it when desired and yet be stable and relatively fixed when in use.

To achieve this, casters or wheels are provided only on the rear leg portions and not on the front leg portions.

The table must also have means to prevent objects on the work surface from falling off as the table is moved or being easily knocked off when the table is being used. This is achieved by the use of a continuous peripheral lip about the side and back edges of the working surface of the table.

Additionally, it is often desirable to provide therapeutic work for a wheelchair occupant, and the parts of the table design of the present invention can be assembled by a wheelchair occupant and finished (stained, painted, etc.) by the occupant.

The foregoing objects are thus achieved in a straightforward, economical and reliable structure, designed by one who has had need for such a system but could find none available in the wheelchair prior art.

The design of the wheelchair table of the present invention allows for mobility and stability, which is important as it is adaptable within the environment. The patient can be stationary, use the two handles located in front of the table and pull it towards himself for a snug fit. The cut out in the work space allows for the table to be pulled close to the individual and gives more support of the arms of the user on the sides.

The table is sturdy, lightweight, mobile and wheelchair accesible. It is open in back, which allows for leg extensions.

Many different craft activities have been performed successfully on the table. If an individual needs less stimulation, the table is easily moved to a more isolated area. Working space on the table is good. The small one inch side guards and back guard aide in holding materials on the table.

The activity wheelchair table is beneficial for use in hospitals, as well as for individuals in their home. The table can be used in a variety of different ways for many individuals.

BRIEF DESCRIPTION OF THE DRAWINGS

For a further understanding of the nature and objects of the present invention, reference should be had to the following detailed description, taken in conjunction with the accompanying drawings in which like parts are given like reference numerals and wherein.

DETAILED DESCRIPTION OF THE PREFERRED EXEMPLARY EMBODIMENT(S)

Figure 4:
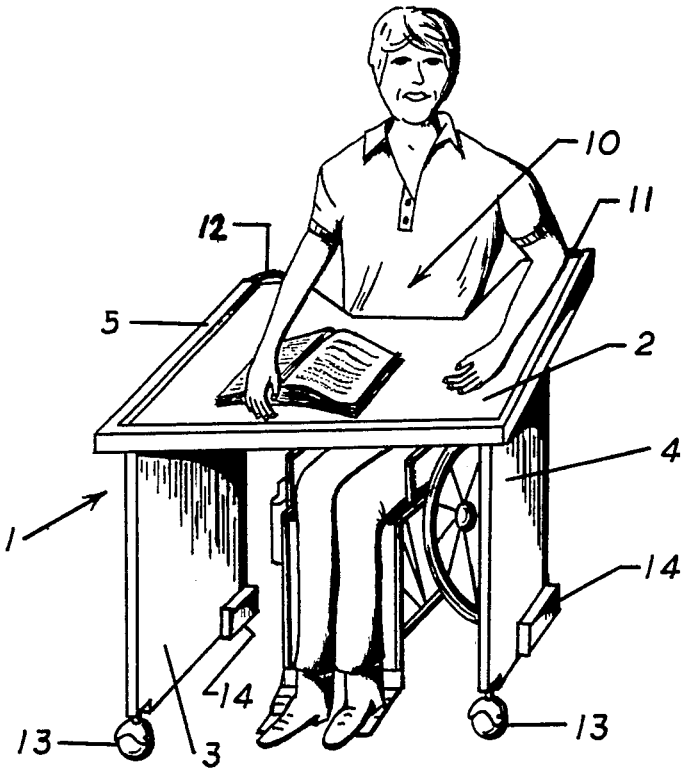
FIG. 4 is a prespective view of the preferred, exemplary embodiment of the present invention shown in use by a wheelchair user.

In used the front edge of the table 1 is tipped up and pulled onto position by the wheelchair occupant when needed. The body of the user fits into the cut back area 10, and the entire work surface area of the table top 2 is within easy arm's reach of the user and is at belly level (note FIG. 4). The table 1 can then be used to work on, or as an is eating or playing surface, as may be desired. The table 1 can travel along with the wheelchair, and easily moved out of the way when desired with the use of, for example, one hand.

The table 1 is of simple design being primarily made from three sections of plywood for elements 2, 3 and 4, which can be obtained from a single standard sheet of plywood. They are simply fastened together with for example screws using the metal angle brackets 6, 7 and the wooden stringers 8, 9. The lath strips 5 are glued, screwed or nailed, and the handles 11, 12 which can be of the simple, metal, screen door type, are screwed on. The wood blocks forming the fixed, front footings 14 and the wheels 13 are attached to the side panels 3, 4. The table is then basically complete except for any desired finished of decorative touches. The parts for the table 1 can be provided to the wheelchair user in kit form, ready for assembly and finishing by the user, which is both cost effective and therapuetic.

Figure 1:
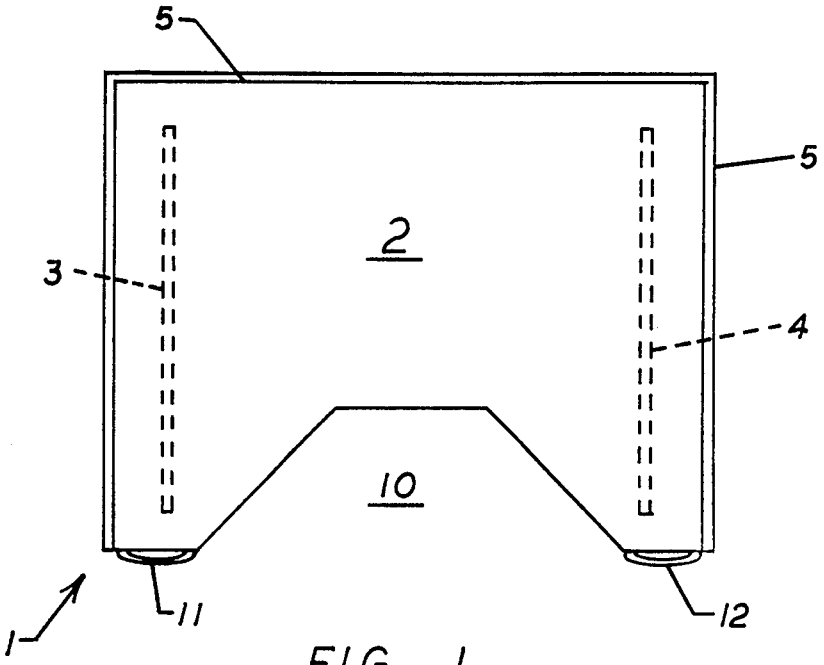
FIG. 1 is a top view of the preferred, exemplary embodiment of the present invention.
Figure 2:
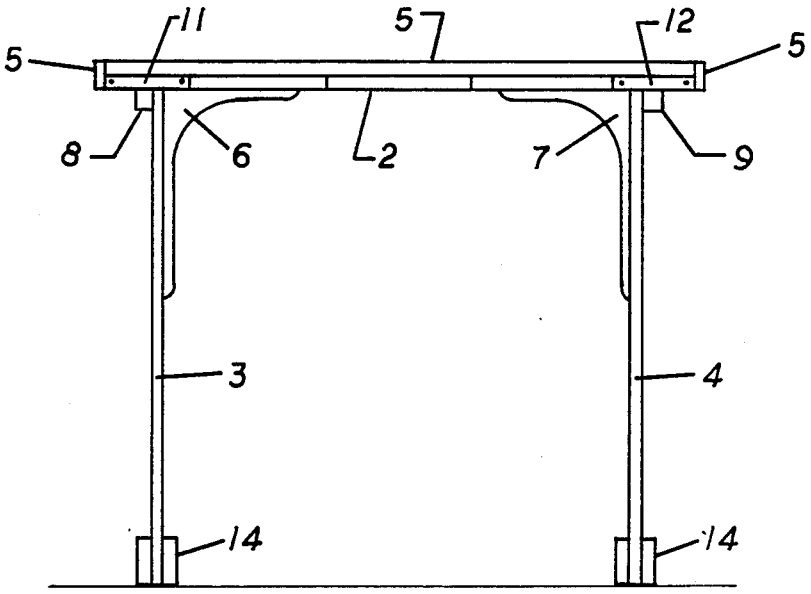
FIG. 2 is a front view of the preferred, exemplary embodiment of the present invention.
Figure 3:
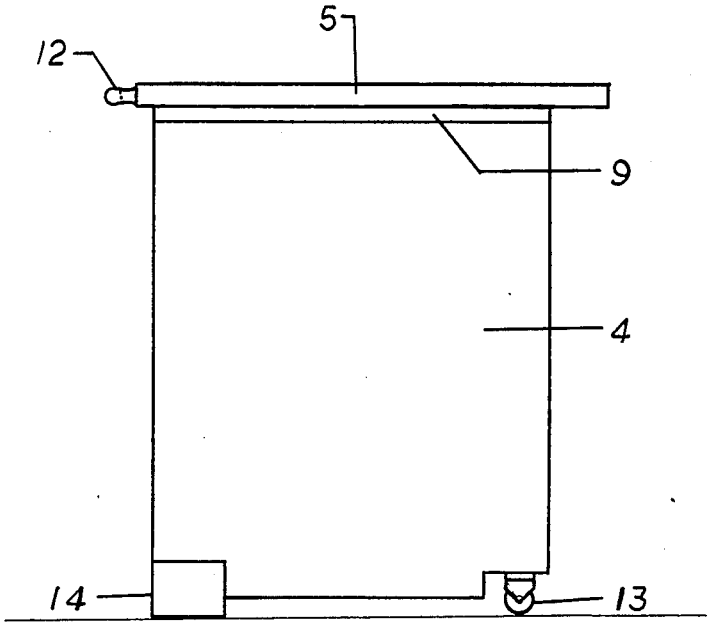
FIG. 3 is a right side view of the preferred, exemplary embodiment of the present invention, with the left side being a mirror image thereof.

As can be seen in FIGS. 1–3, the preferred embodiment of the wheelchair table system 1 of the present invention includes a planer table top 2 supported by two side support leg panels 3, 4 which in effect provide front and rear support members for and on each side of the table top 2. A modesty panel (not illustrated) can be provided across the back sides of the support panels 3,4, if desired. A continuous peripheral lip 5 extends above the table top 2 forming a ridge or barrier about the side and back edges of the table top 2.

Triangular or angle braces 6,7 are included to strengthen and rigidify the table structure and the connections between the top 2 and the side leg panels 3,4. Additionally, side, longitudinally extended, fastening stringers 8,9 are included along the tops of the side leg panels 2,3. Screws are used to fasten the stringers to the table top 2 and the side panels 3,4.

In the front of the table top 2 is a cut back portion 10, either curved or angled back as shown to mate with and allow the user to sit or the user's body to extend within the table's working surface 2. The working surface 2 thus extends not only in front of the user but also partially along the sides of the user (note FIG. 4).

Grab handles 11,12 are also preferrably provided at the front, side edges of the table top 2. This allows the user to firmly but easily grip the table 1 top, particularly when it is desired to move it toward the user, by for example pulling it into use before the seated user, or thereafter move it away.

As can best be seen in FIG. 3, casters or wheels 13 are provided at only rear or back side portions of the panels 3,4, with fixed, extended surface, support blocks 14 being provided at the front side portions (also note FIG. 2). When the table 1 is at rest on the floor, the laterally and longitudinally extended bottom floor engaging surfaces of the blocks 14 keeps the table 1 stably supported and relatively immobile. However, when it is desired to move the table 1, its front edge is merely tipped up using the handles 11,12 or gripping the table top 2, which shifts the weight of table 1 back onto the rollers 13. The table 1 is then easily moved on the rear rollers or wheels 13. During this operation the peripheral edging barrier 5 prevents any objects on the table top 2 from falling or rolling off.

It is important that the table top 2 be of a size that all of the working surface is within the arm's reach of the handicapped user. A width of about thirty-six inches and a depth along the side edges of about twenty-eight inches for the typical user has been found to be preferred. Plywood three-quarters inch thick, for example, has been found to be suitable for the table top 2 and the side leg panels 3,4, with the leg panels having a width in the longitudinal (front-to-back) direction of for example twenty-four inches.

It is also very important that the height of the table top 2 being such to clear the arms of the wheelchair, typically being twenty-four to twenty-eight inches off the floor, but not be too high to be uncomfortable for the user, and about thirty inches has been found to be preferred. The peripheral edging 5 can be for example lath strips of one quarter inch wide with a height of for example one and five-eighths inch. Footing blocks 14 having a longitudinal length of five inches with an effective width of approximately two and three-quarters inches also are suitable.

Such a table with the foregoing construction has an approximate weight of thirty-five pounds, and can easily be moved about by a handicapped wheelchair occupant.

Because many varying and different embodiments may be made within the scope of the inventive concept herein taught, and because many modifications may be made in the embodiment herein detailed in accordance with the descriptive requirements of the law, it is to be understood that the details herein are to be interpreted as illustrative and not in a limiting sense.

What is claimed is:

1. A wheel chair table system, comprising:

a horizontal planar surface disposed generally above a pair of horizontally parallel arms of a wheelchair, said planar surface having a generally straight rear edge, a pair of generally parallel side edges extending laterally forward from the ends of said rear edge and separated by a distance generally wider than said arms of said wheelchair, and a front edge extending laterally between the forward ends of said side edges and generally parallel to said rear edge;

a notch in said front edge extending rearward into said planar surface, said notch having a straight rear edge portion disposed generally parallel to said rear edge and a pair of straight side edges extending angularly outward from said rear edge to define a cut out having a narrower rear portion and a wider front portion;

a pair of generally opposed planar side members extending laterally downward from a lower surface of said planar surface;

means for retaining said planar side members and said planar surface in a rigidified configuration;

a pair of opposed rollers formed by attaching a roller to a rear, lower portion of each of said side members to provide for movement of said planar surface, said opposed rollers further being disposed in a vertical plane generally parallel to said rear edge of said planar member to provide a means for rotating said planar surface to a tilted configuration with its front edge raised to a position higher than its rear edge;

a footing extending downward from a front, lower portion of each of said side members having a lower surface suitable for engaging a floor surface to prevent lateral motion thereon, said footings forming a pair of opposed footings for restraining lateral motion of said planar surface;

a handle attached to a portion of said front edge on both sides of said cut out for use by an invalid in a wheel chair to rotate and lift said planar surface about said opposed rollers upward from a first configuration in which said footing engages said floor surface and a configuration in which said cut out in part, surrounds a forward body portion of said invalid, to a second configuration in which said cut out rotates with said planar surface and moves upward along a frontal periphery of said invalid to allow said planar surface to rotate to its tilted configuration with its front edge in a higher position than its rear edge while remaining in a configuration in which said cut out in part, still surrounds a forward body portion of said invalid, to further allow a separation between said footing and said flooring so that said planar surface may be moved about by said invalid from a first location to a second location with said wheel chair; and a lip extending around at least three edges of said planar surface, said lip having a portion extending upward from said rear edge and including generally parallel portions extending upward from said side edges to provide a means when said planar surface is in its tilted configuration for retaing articles on said planar surface.

* * * * *